US008177915B2

(12) United States Patent
Francisco et al.

(10) Patent No.: US 8,177,915 B2
(45) Date of Patent: May 15, 2012

(54) FILTRATION SYSTEM FOR A DISHWASHER, AND ASSOCIATED APPARATUS AND METHOD

(75) Inventors: Virgil J. Francisco, Ayden, NC (US); Mark D. Montgomery, Greenville, NC (US); Ashish A. Verma, Winterville, NC (US); David E. House, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 451 days.

(21) Appl. No.: 12/465,267

(22) Filed: May 13, 2009

(65) Prior Publication Data

US 2010/0288306 A1 Nov. 18, 2010

(51) Int. Cl.
*B08B 3/02* (2006.01)
*B08B 3/14* (2006.01)
*B01D 35/02* (2006.01)

(52) U.S. Cl. ..... 134/25.2; 134/56 D; 134/58 D; 134/10; 134/104.4; 134/109; 134/110; 134/111; 210/805

(58) Field of Classification Search ..... 134/25.2, 134/56 D, 58 D, 10, 110, 111; 210/805
See application file for complete search history.

(56) References Cited

U.S. PATENT DOCUMENTS 3,217,884 A 11/1965 Long
3,807,419 A 4/1974 Cushing et al.
4,201,345 A * 5/1980 Ziegler ..... 241/46.012
4,998,548 A 3/1991 Lagerstrand
5,609,172 A 3/1997 Chang et al.
6,103,017 A * 8/2000 Thies et al. ..... 134/10
6,182,674 B1 2/2001 Jozwiak et al.
6,805,142 B2 10/2004 Kim et al.
7,404,864 B2 7/2008 Welch
2005/0133072 A1 6/2005 Yoon et al.
2008/0041419 A1 2/2008 Gaus

FOREIGN PATENT DOCUMENTS

EP 0 990 413 A1 4/2000
EP 1 256 308 A2 11/2002
JP 01284223 A 11/1989

* cited by examiner

*Primary Examiner* — Michael Kornakov
*Assistant Examiner* — Natasha Campbell
(74) *Attorney, Agent, or Firm* — Alston & Bird LLP

(57) ABSTRACT

A filtration system for a dishwasher, and an associated apparatus and method, are provided, comprising a macerator chamber adapted to house a macerator device. The macerator chamber is configured to receive washing fluid for the macerator device to comminute contaminants within the washing fluid. A drain chamber is in fluid communication with the macerator chamber and is configured to receive the washing fluid and comminuted contaminants therefrom via a fluid port therebetween. The drain chamber has a vented member associated therewith, which defines at least one first vent providing fluid communication between the drain chamber and the washing fluid circulation system. The vented member is spaced apart from the fluid port, and is configured to strain the comminuted contaminants from the washing fluid so as to retain the comminuted contaminants within the drain chamber while allowing the washing fluid to pass therethrough to the washing fluid circulation system.

20 Claims, 10 Drawing Sheets

FILTRATION SYSTEM FOR A DISHWASHER, AND ASSOCIATED APPARATUS AND METHOD

BACKGROUND OF THE INVENTION

1. Field of the Invention

Aspects of the present disclosure are directed to dishwashing appliances and, more particularly, to a filtration system for a dishwashing appliance, and an associated apparatus and method.

2. Description of Related Art

The effectiveness of a dishwasher may often be directly related to conditions associated with the washing fluid used thereby. Generally, a dishwasher implements a gravity-fed sump assembly for receiving washing fluid from a house source, from which the washing fluid is circulated by a circulation pump through various spray arms or other fluid-distribution provisions of the dishwasher for removing soils from the dishware disposed therein. After removing the soils and other debris from the dishware, the washing fluid is typically directed through a series of straining/filtering mechanisms associated with the sump assembly prior to being re-circulated through the hydraulic system of the dishwasher.

In some instances, one such straining/filtering mechanism associated with the sump assembly incorporates a drain chamber which acts as a buffer volume for soils-laden washing fluid prior to such washing fluid being pumped out of the dishwasher during a drain cycle performed by the dishwasher. In some instances, the drain chamber may be a so-called "still chamber" where the collected soils are allowed to settle out in the drain chamber. In such instances, the "still chamber" configuration avoids such soils being broken down by washing fluid turbulence/motion and subsequently dispersing back into the circulated washing fluid.

However, in some instances, the dishwasher may also implement a macerator chamber housing a rotating macerator device to chop and break down food soils, though such a macerator chamber may be disposed opposite the drain chamber from the house drain (i.e. the macerator chamber may be fluidly disposed prior to the drain chamber from the house drain). As such, in those instances, the spinning macerator blade and its supporting shaft may create turbulence in the soils-laden washing fluid within the macerator chamber, and this turbulence may, in turn, affect food soils in the drain chamber. As a result, the turbulence may cause the food soils to be driven into the drain chamber and/or expelled from the drain chamber through fluid pathways. To the extent that the food soils are undesirably expelled from the drain chamber and/or macerator chamber, such food soils may undesirably be driven back into the clean, re-circulating washing fluid and eventually onto the dishware disposed within the dishwasher.

Thus, there exists a need for a filtration system and method for permitting a flow (or overflow) of the soils-laden washing fluid with respect to the drain chamber of a dishwasher, the soils-laden washing fluid being received from the macerator chamber of the dishwasher, so as to contain the food soils and contaminants within the drain chamber while facilitating the necessary washing fluid level in the washing fluid circulation system, without re-introducing such food soils/contaminants back into the washing fluid circulation system, and prior to the soils being pumped out of the drain chamber, and out of the dishwasher, during the drain cycle.

BRIEF SUMMARY OF THE INVENTION

The above and other needs are met by embodiments of the present invention which, according to one aspect, provides a filtration system for a dishwasher. Such a system comprises a macerator chamber adapted to house a macerator device, wherein the macerator device and the macerator chamber form a macerator system separately operable from a washing fluid circulation system. The macerator chamber is configured to receive washing fluid for the macerator device to comminute contaminants within the washing fluid. A drain chamber is in fluid communication with the macerator chamber and is configured to receive the washing fluid and comminuted contaminants therefrom via a fluid port therebetween. The drain chamber has a vented member associated therewith, and the vented member defines at least one first vent providing fluid communication between the drain chamber and the washing fluid circulation system. The vented member is spaced apart from the fluid port, and is configured to strain the comminuted contaminants from the washing fluid so as to retain the comminuted contaminants within the drain chamber while allowing the washing fluid to pass therethrough to the washing fluid circulation system.

Another aspect provides a dishwashing appliance, comprising a tub portion adapted to receive dishware therein. A washing fluid circulation system is configured to circulate washing fluid about the dishware within the tub portion. A maceration system is separately operable with respect to the washing fluid circulation system and in fluid communication with the tub portion. The maceration system comprises a macerator device housed by a macerator chamber configured to receive washing fluid from the tub portion for the macerator device to comminute contaminants within the washing fluid. A drain chamber is in fluid communication with the macerator chamber and is configured to receive the washing fluid and comminuted contaminants therefrom via a fluid port therebetween. The drain chamber has a vented member associated therewith, and the vented member defines at least one first vent providing fluid communication between the drain chamber and the washing fluid circulation system. The vented member is spaced apart from the fluid port, and is configured to strain the comminuted contaminants from the washing fluid so as to retain the comminuted contaminants within the drain chamber while allowing the washing fluid to pass therethrough to the washing fluid circulation system.

Yet another aspect provides a method of filtering contaminants in a dishwasher. Such a method comprises circulating washing fluid about dishware within a tub portion with a washing fluid circulation system in fluid communication therewith. The method further comprises directing the washing fluid from the tub portion to a maceration system separately operable with respect to the washing fluid circulation system. The maceration system comprises a macerator device housed by a macerator chamber configured to receive the washing fluid for the macerator device to comminute contaminants therein. The method further comprises directing the washing fluid and comminuted contaminants from the macerator chamber to a drain chamber via a fluid port therebetween. The drain chamber has a vented member associated therewith, and the vented member is spaced apart from the fluid port and defines at least one first vent providing fluid communication between the drain chamber and the washing fluid circulation system. The method further comprises straining the comminuted contaminants from the washing fluid with the vented member so as to retain the comminuted contaminants within the drain chamber while allowing the washing fluid to pass through the at least one first vent to the washing fluid circulation system.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 8:
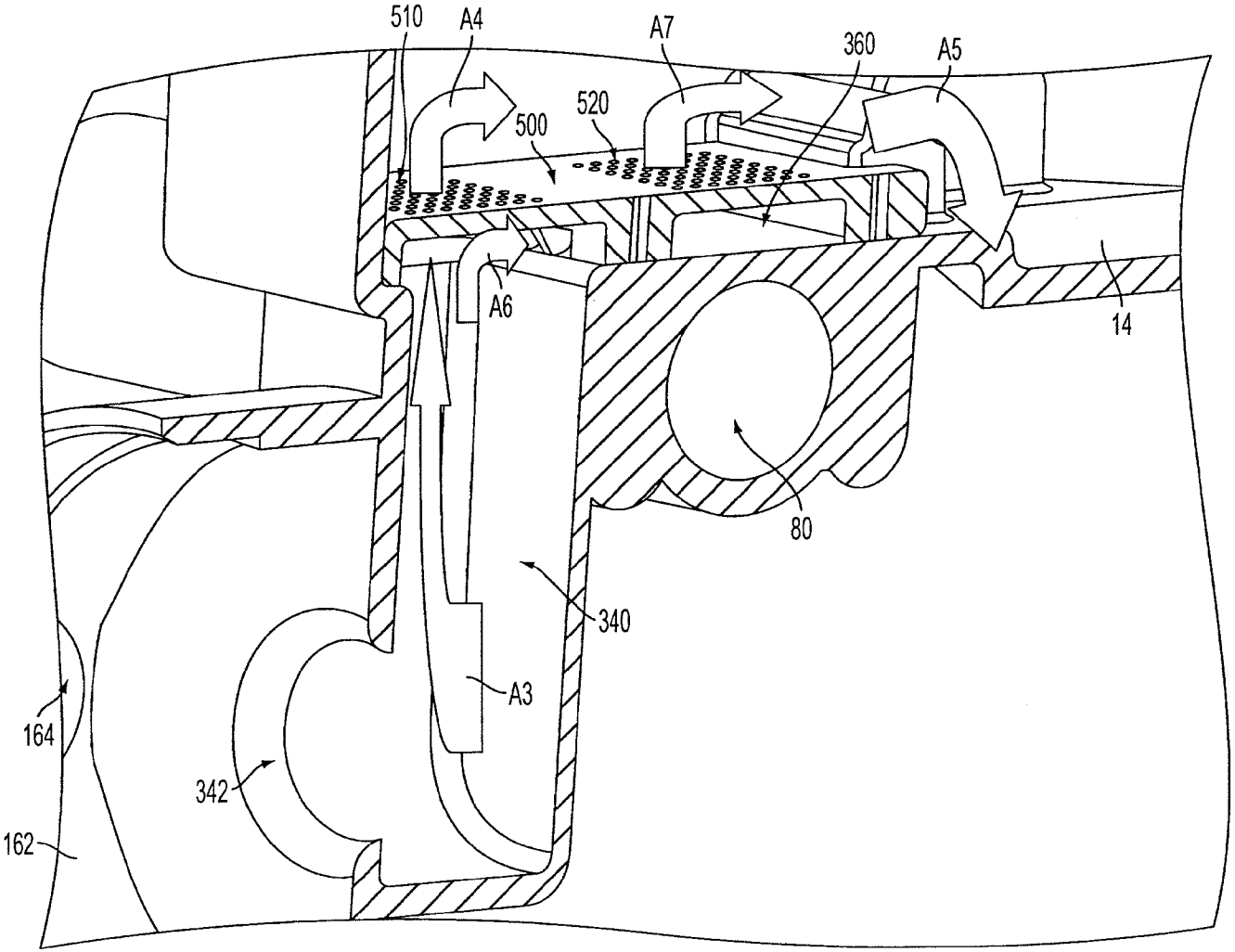
Figure 9:
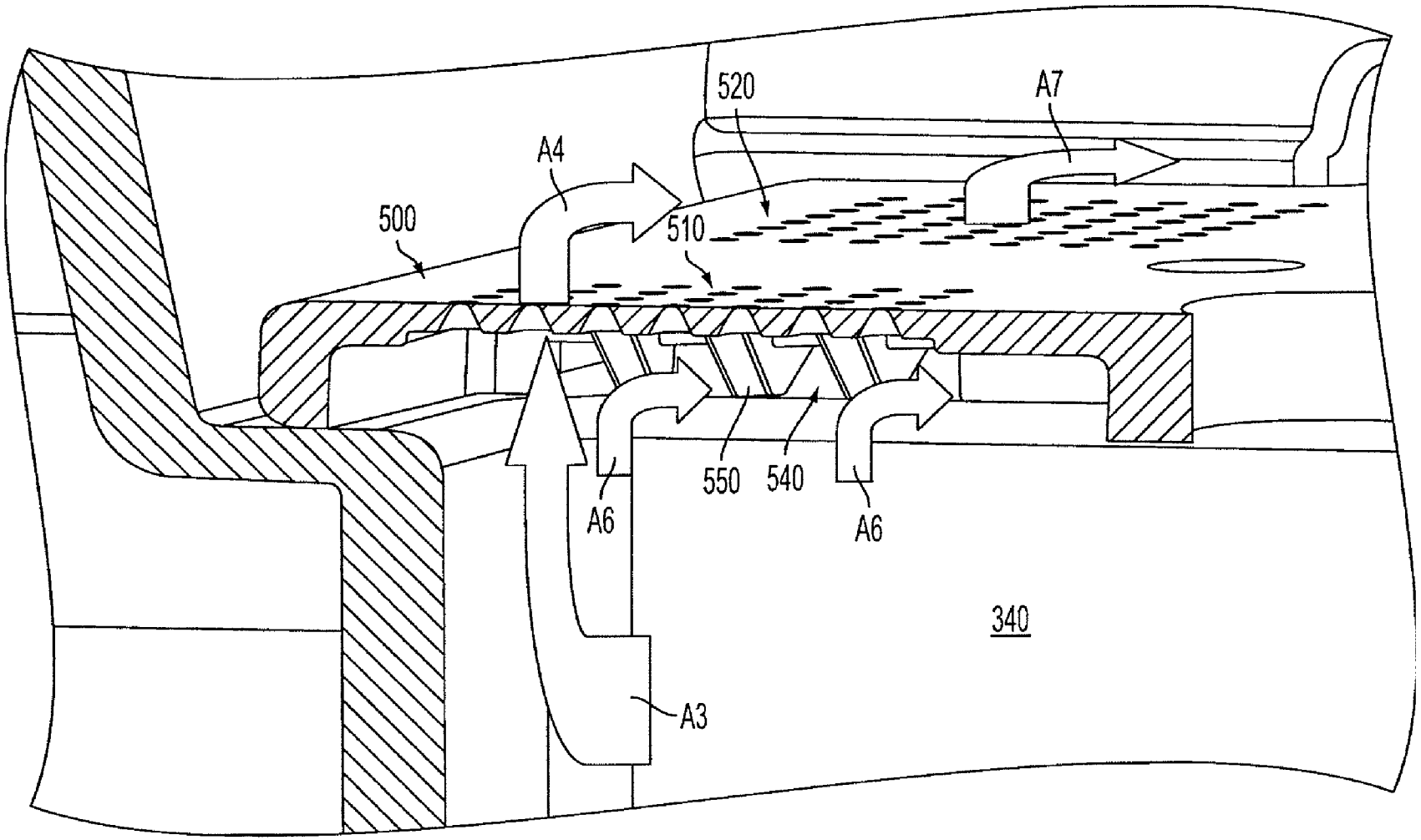
Figure 10:
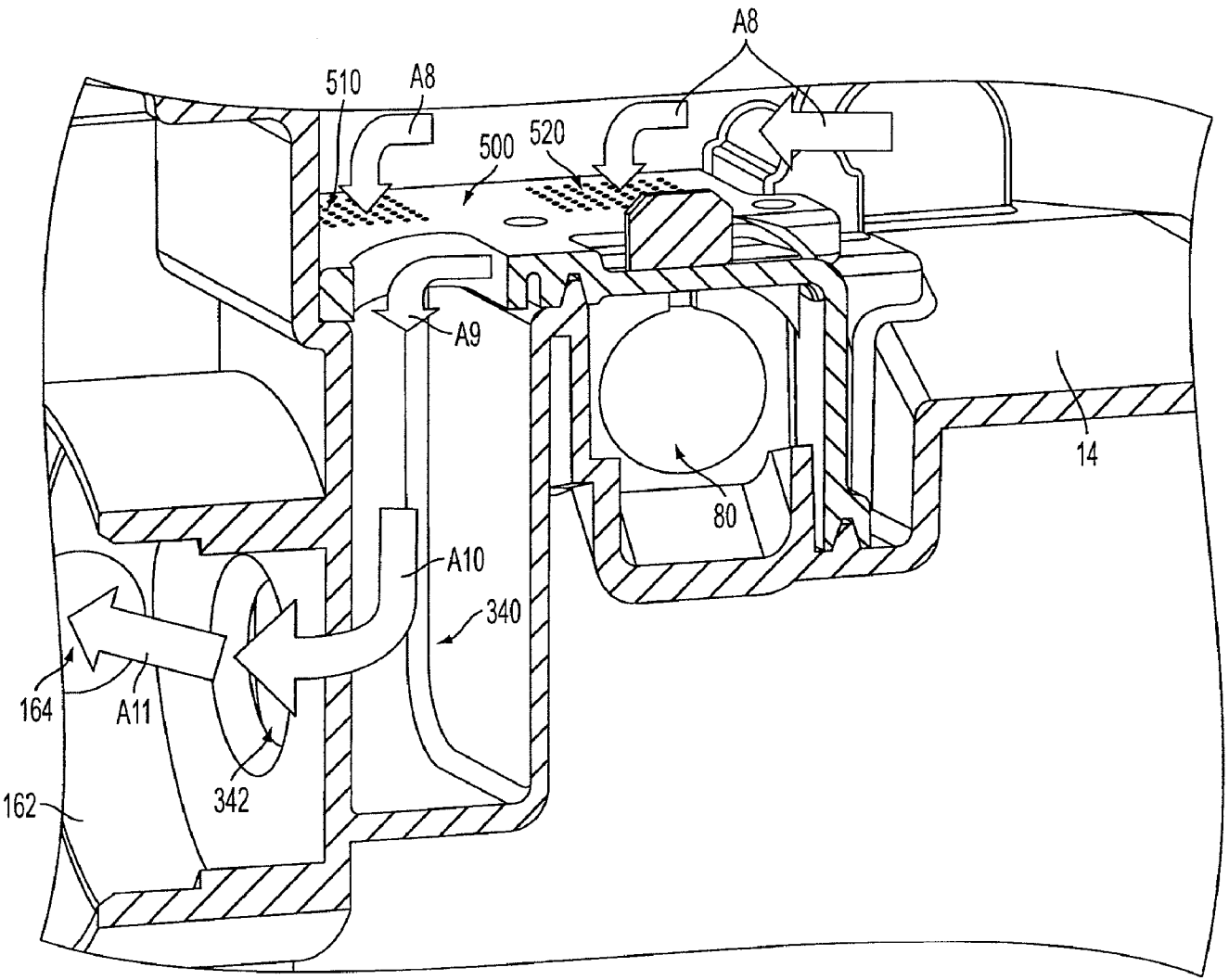

FIG. 8 is a is a perspective cross-sectional view of a filtration system comprising a macerator chamber and a separately operable drain chamber having a vented member associated therewith, according to one embodiment of the present disclosure, illustrating the flow of washing fluid exiting the drain chamber through the vented member, and also illustrating the flow of washing fluid between the drain chamber and a particle collection chamber;

FIG. 9 is a magnified view of a drain chamber of a filtration system having a vented member associated with the drain chamber, wherein the vented member at least partially defines a washing fluid channel for facilitating lateral flow of washing fluid and comminuted contaminants between the drain chamber and a particle collection chamber, according to one embodiment of the present disclosure; and FIG. 10 is a perspective cross-sectional view of a filtration system comprising a macerator chamber and a separately operable drain chamber having a vented member associated therewith, according to one embodiment of the present disclosure, illustrating the backflow of washing fluid through the vented member into the drain chamber.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
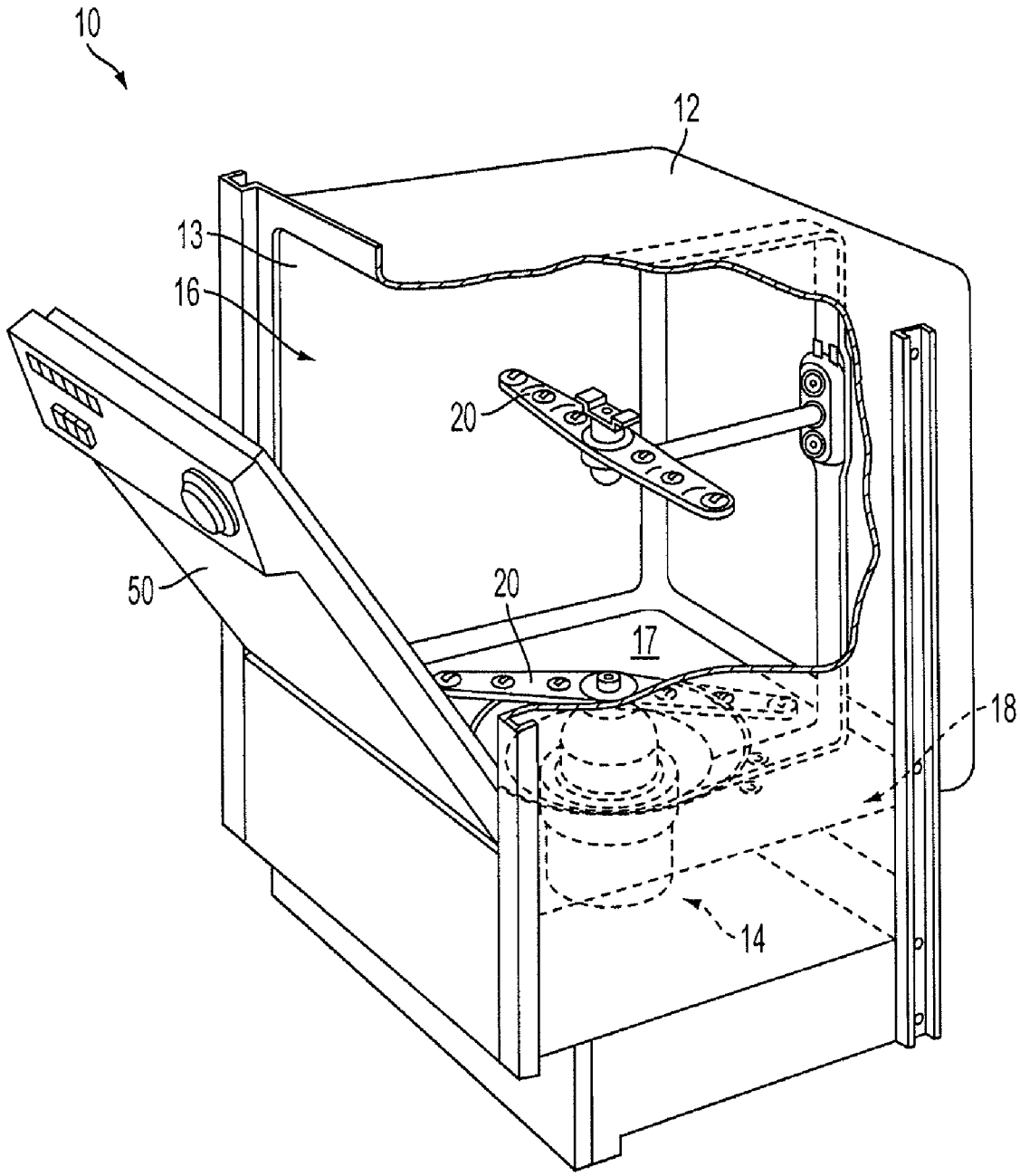
FIG. 1 is a perspective view of a dishwasher capable of implementing various embodiments of the present disclosure.

FIG. 1 illustrates one example of a dishwashing appliance, such as a dishwasher 10, capable of implementing various embodiments of the present invention. Such a dishwasher 10 includes a tub portion 12 (partly broken away in FIG. 1 to show internal details) having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and dishware to be washed. A door assembly 50 may be pivotably engaged (i.e., hinged) with the tub portion 12 about the lower end 18 thereof so as to selectively permit access to the interior of the tub portion 12. That is, the door assembly 50 may be pivotable to provide access to the interior of the tub portion 12 through the forward access opening 16, and to cover and seal the forward access opening 16 when the dishwasher 10 is in operation.

Figure 2:
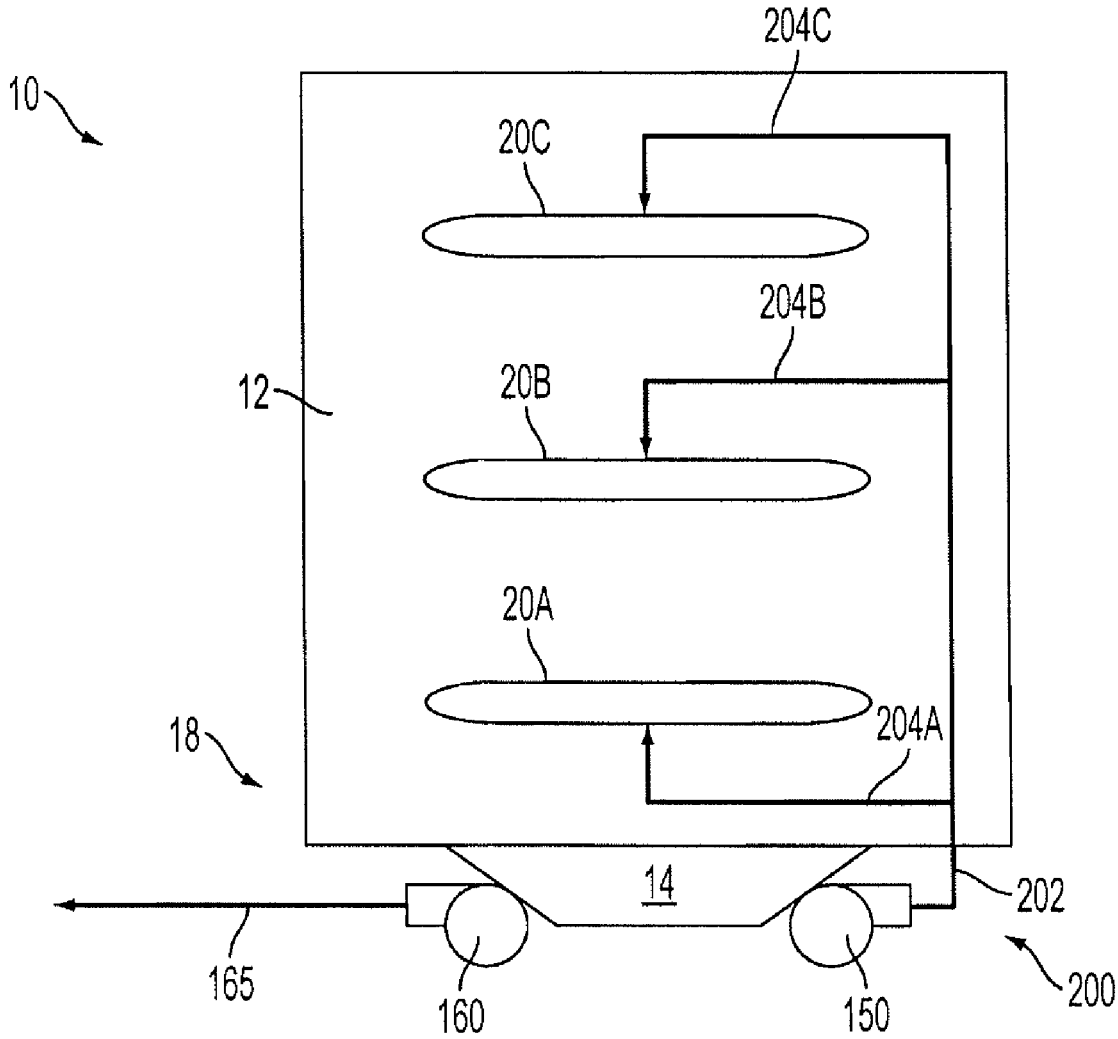
FIG. 2 is a schematic of a dishwashing appliance capable of implementing various embodiments of the present disclosure.
Figure 3:
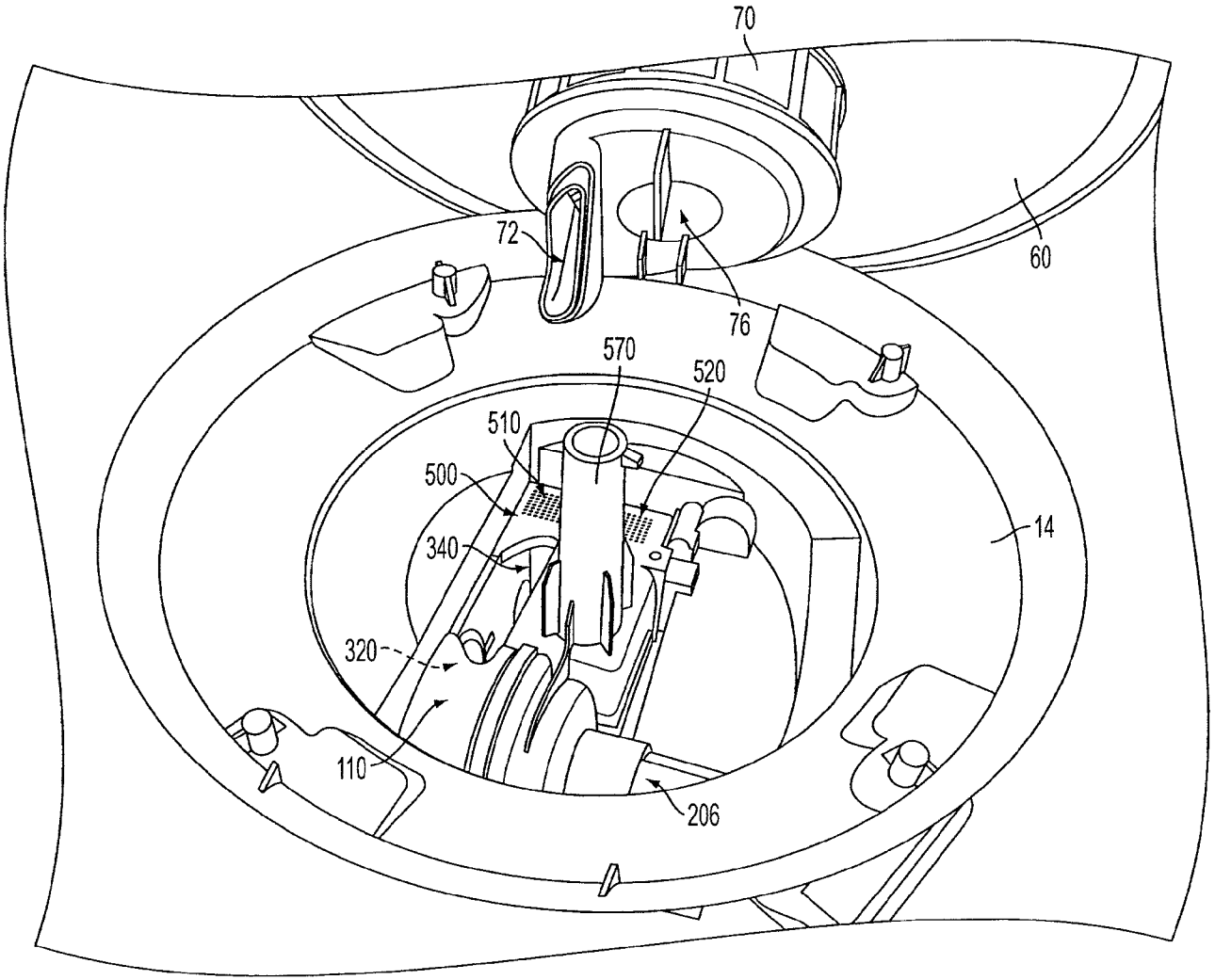
FIG. 3 is a perspective view of a sump assembly and a filtration system comprising a drain chamber having a vented member associated therewith, according to one embodiment of the present disclosure.
Figure 7:
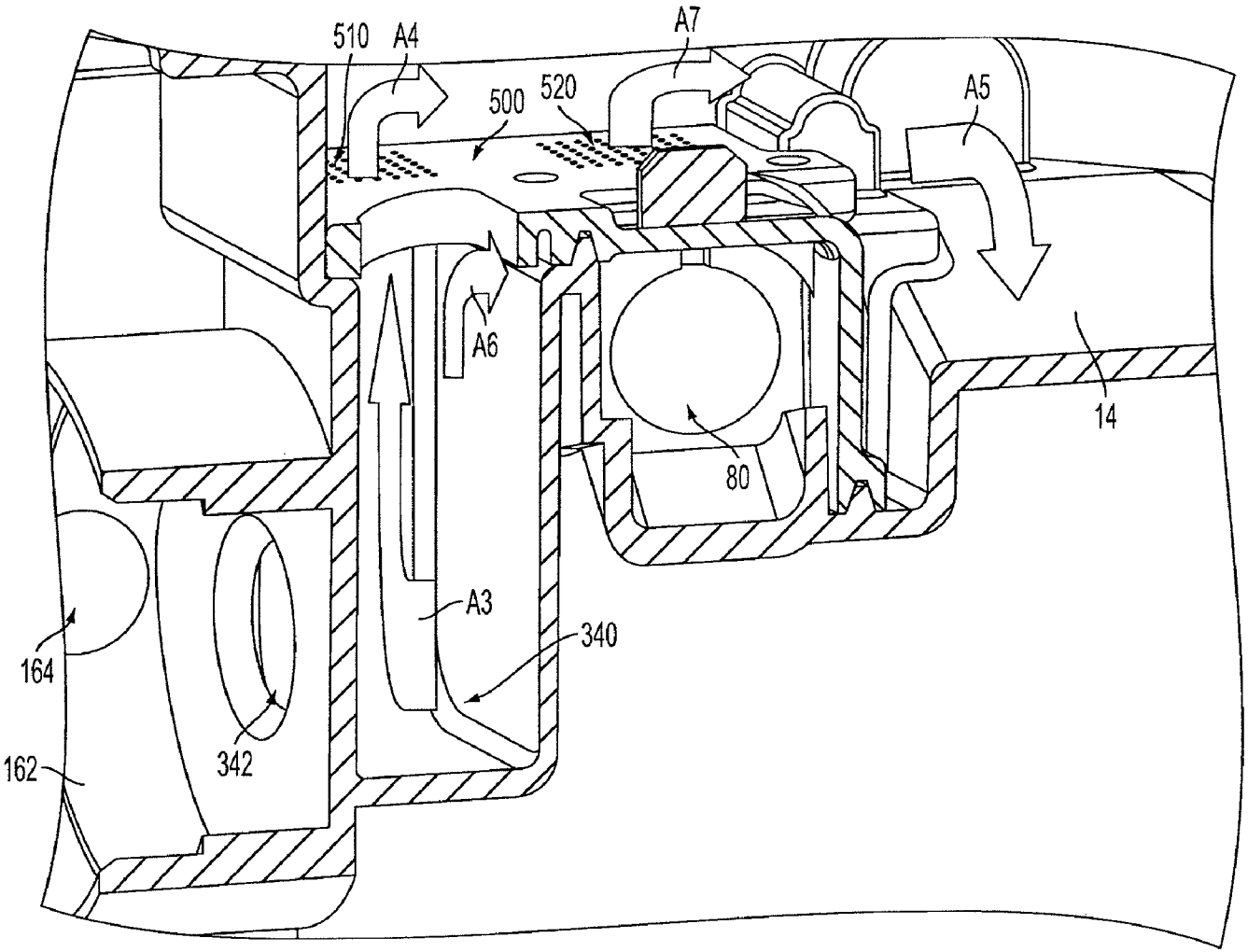
FIG. 7 is a perspective cross-sectional view of a filtration system comprising a macerator chamber and a separately operable drain chamber having a vented member associated therewith, according to one embodiment of the present disclosure, illustrating the flow of washing fluid exiting the drain chamber through the vented member.

The tub portion 12 may further define or have engaged therewith a sump (or sump assembly), generally designated as 14, in which wash water or rinse water is collected, typically under the influence of gravity. The sump 14 may cooperate with a bottom wall 17 of the tub portion 12 to form the lower end 18 of the tub portion 12, wherein the bottom wall 17 may be sloped to direct washing fluid toward the sump 14. With reference to FIG. 2, the washing fluid collected in the sump 14 may be re-circulated by a circulation pump 150 through various water distribution provisions (e.g, spray arm (s) 20 (FIG. 1)) during each of the wash and rinse cycles typically implemented by the dishwasher 10. That is, the circulation pump 150 may be disposed in communication with a washing fluid circulation system 200 of the dishwasher's hydraulic system. The washing fluid circulation system 200 of the dishwasher 10 may include a delivery channel 202 and associated manifold portions 204A, 204B, 204C for delivering dishwashing fluid from the circulation pump 150 to the respective spray arms 20A, 20B, 20C. That is, the delivery channel 202 is operably engaged with the circulation pump 150 for transporting the washing fluid to the spray arms 20A, 20B, and 20C. As shown in FIG. 3, the washing fluid circulation system 200 may further include a circulation pump fluid inlet 206 for transporting dishwashing fluid from the sump 14 to the circulation pump 150. According one embodiment, the circulation pump fluid inlet 206 may be at least partially defined by the sump 14. As shown in FIGS. 7, 8, and 10, the sump 14 may define or otherwise include a washing fluid outlet 80 which connects to the delivery channel 202 for transporting washing fluid under pressure to, for example, the upper spray arms 20B and 20C for spraying washing fluid within the tub portion 12 and about the dishware contained therein.

Referring to FIGS. 3 and 6-10, therein is shown a filtration system 300 configured in accordance with an exemplary embodiment of the present invention. The filtration system 300 may generally comprise a macerator chamber 320 and having a drain chamber 340 in communication therewith. In this regard, washing fluid draining toward the sump 14 from the tub portion 12 passes through a first filter device 60 (which is not necessarily considered a component of the filtration system 300 described herein) comprising a coarse filter surrounding a second filter device 70 (which is also not necessarily considered a component of the filtration system 300 described herein), such as a "glass trap." As generally illustrated by arrows A1 (illustrating the directional path of the washing fluid), the washing fluid passing through the coarse filter (i.e., sufficiently "clean") may be collected by the sump 14 and directed to the circulation pump fluid inlet 206 and the circulation pump 150 (the circulation pump 150 comprising a circulation pump impeller (not shown) housed by a circulation pump housing at least partially defining the circulation pump fluid inlet 206) for re-circulation. Generally, contaminants too large to fit or otherwise pass through the first filter device 60 (i.e., the coarse filter) may be directed by the washing fluid toward the second filter device 70 (i.e., the glass trap) which, in some instances, may be centrally disposed at the lower end 18 of the dishwasher 10. As generally illustrated by arrows A2, the washing fluid/large contaminants entering the second filter device 70 may be directed through a filter fluid outlet 72 to a macerator system 400 comprised of a macerator (disposal/chopper/comminution) device (not shown) housed by the macerator chamber 320. The macerator device operates to reduce the size of (comminute) the food soils and debris removed from the dishware, and directed therethrough via the glass trap.

In some instances, the macerator device may be driven by a circulation pump motor associated with the circulation pump 150 (though, in other instances, the macerator device may be driven by a separate motor). As such, in those instances, the macerator chamber 320 may be located proximate to or otherwise associated with the circulation pump 150 (FIG. 2). However, the macerator function (as directed by the macerator system 400) is otherwise separately operable from the washing fluid recirculation function (as directed by the washing fluid circulation system 200). In this regard, according to one aspect of the present invention, the washing fluid circulation system 200 may be separately operable from the macerator system 400. That is, the washing fluid circulation system 200 and the macerator system 400 may form separate fluid circuits within the overall hydraulic system of the dishwasher 10. According to some embodiments, a separator device 90 (FIG. 6) such as a seal or chamber wall may be provided to separate the circulation pump fluid inlet 206 (and/or the circulation pump chamber) and the macerator chamber 320 so as to prevent soiled washing fluid present in the macerator chamber 320 from mixing with relatively clean washing fluid which enters the circulation pump fluid inlet 206.

In any instance, once the larger contaminants are acted upon by the macerator device, the washing fluid/macerated particles are directed from the macerator chamber 320 to the drain chamber 340 via a fluid port 310, as generally illustrated by arrow A3. As shown in FIGS. 7, 8, and 10, the drain chamber 340 defines a drain chamber port 342 that forms the drain pump inlet to a drain pump 160 (FIG. 2) comprising a drain pump impeller (not shown) housed by a drain pump housing 162. The drain pump 160 is configured to pump/remove washing fluid from the sump 14 through a drain pump fluid outlet 164 and into a house drain (sewer) line, after the washing fluid is used to wash dishware disposed within the tub portion 12. In some instances, an outlet member 165 or hose is operably engaged with the drain pump 160/drain pump fluid outlet 164 for transporting the washing fluid from the drain pump 160 into the house drain line.

Referring to FIGS. 2-5, therein is shown a vented member, generally designated 500, configured in accordance with an exemplary embodiment of the present invention. The vented cover member 500 is associated with the drain chamber 340 in spaced-apart relation with respect to the fluid port 310 and is configured to allow washing fluid to pass therethrough (as generally illustrated by arrow A4), while substantially retaining comminuted contaminants within the drain chamber 340 (i.e., as a strainer or filter) That is, in order to permit the flow (or overflow) of the soils-laden washing fluid with respect to the drain chamber 340 to the washing fluid circulation system 200, while retaining the food soils and contaminants within the drain chamber 340 (since the drain chamber port 342 is effectively "closed" during a washing fluid circulation procedure), the vented member 500 is configured to separate the drain chamber 340 from the sump 14, wherein the vented member 500 includes or otherwise defines at least one first vent, generally designated 510, for allowing the washing fluid to pass therethrough, back into the sump 14, while retaining the macerated contaminants within the drain chamber 340. In this manner, the vented member 500 may be configured to act as a filter/strainer to maintain particles/contaminants within the drain chamber 340 while allowing the washing fluid having the particles/contaminants removed therefrom to re-enter the sump 14 for re-circulation by the washing fluid circulation system 200. As generally illustrated by arrows A5, the washing fluid passing through the vented member 500 and back into the sump 14 may then be directed toward the circulation pump fluid inlet 206 (due to the configuration of the sump 14) for re-circulation.

In one embodiment, the first vent(s) 510 defined by the vented member 500 may be generally spaced apart from the fluid port 310. In some instances, the first vent(s) 510 may be disposed on the opposite end of the drain chamber 340, away from the fluid flow entrance (i.e., the fluid port 310) into the drain chamber 340 from the macerator chamber 320. According to some aspects of the present invention, the first vent 510 defined by the vented member 500 associated with the drain chamber 340 may be located in general proximity to the circulation pump fluid inlet 206, wherein such a configuration effectively shortens the washing fluid return path from the drain chamber 340 to the circulation pump 150 and thus helps to minimize the amount of washing fluid required for the circulation pump 150 to operate without starvation/cavitation. Less water required for circulation pump operation may also result in lower energy use and lower water consumption. For example, because less washing fluid is needed, less energy may be needed to heat the lesser amount of washing fluid volume in processes requiring the washing fluid to be heated.

Figure 4:
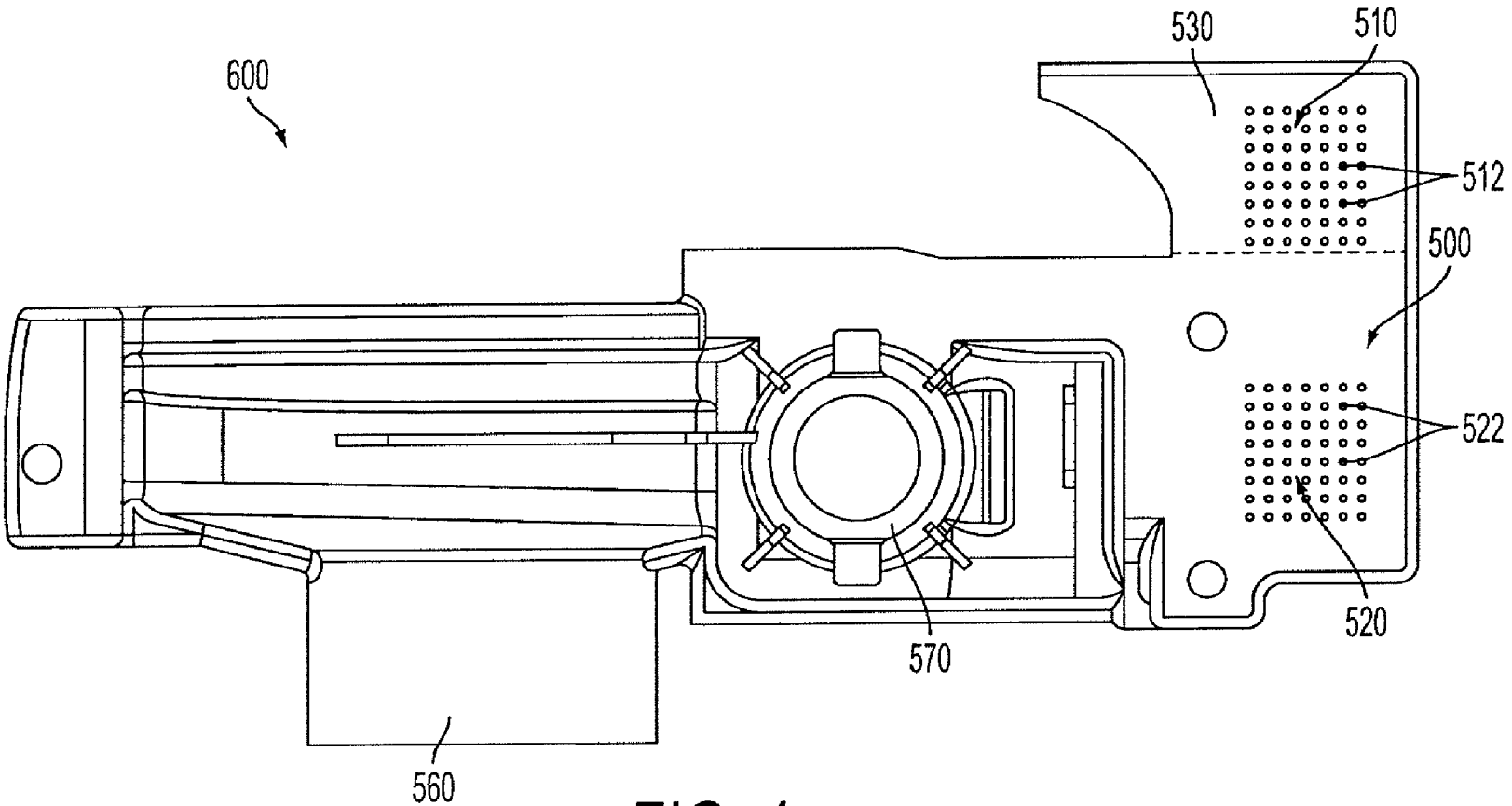
FIG. 4 is a top elevation view of a vented member configured in accordance with an exemplary embodiment of the present disclosure.
Figure 5:
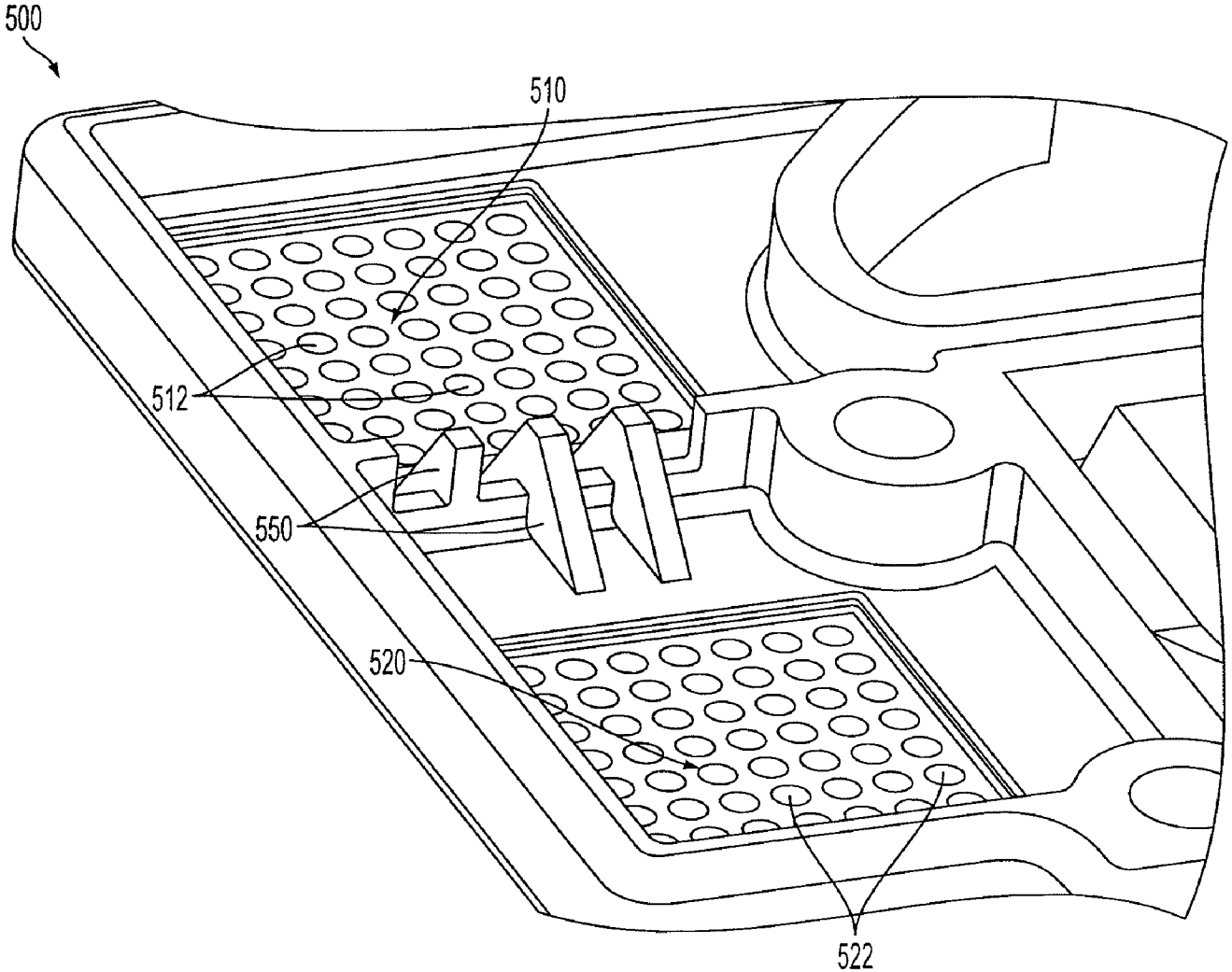
FIG. 5 is a partial perspective view of a vented member configured in accordance with an exemplary embodiment of the present disclosure.
Figure 6:
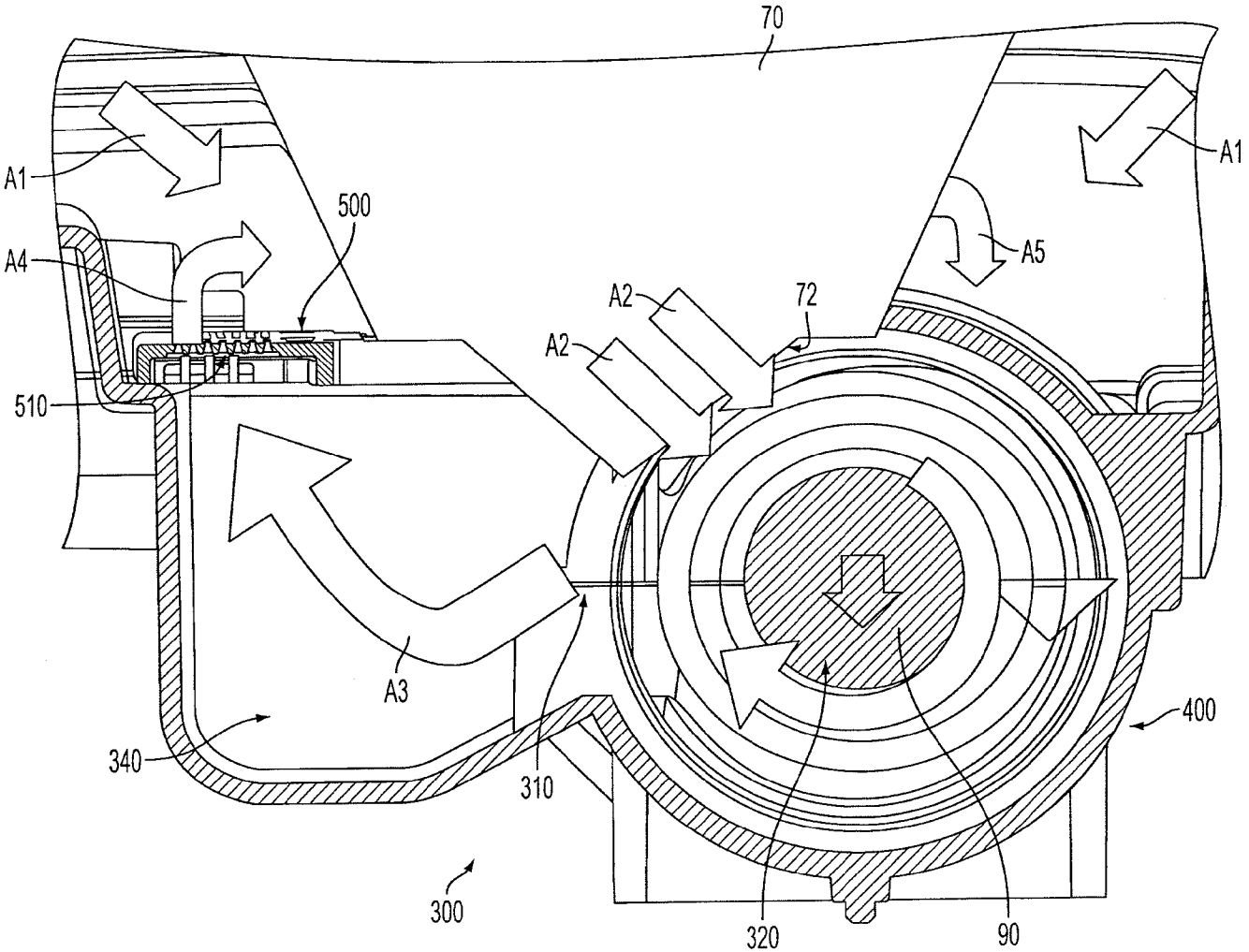
FIG. 6 is a cross-sectional view of a filtration system comprising a macerator chamber and a separately operable drain chamber having a vented member associated therewith, according to one embodiment of the present disclosure, illustrating the flow of washing fluid entering the filtration system.

According to one particular embodiment, as shown in FIG. 4 and as disclosed further herein, the vented member 500 may form a portion of or otherwise be implemented in connection with the circulation pump housing of the circulation pump 150. For example, the vented member 500 may be formed as a portion of or otherwise associated with a cover member 600 portion of the circulation pump housing disposed within the sump 14. In this regard, the vented member 500 may be integrally formed with the cover member 600, or otherwise attached to the cover member 600, wherein the cover member 600 cooperates with a circulation pump volute receptacle 110 to define the circulation pump housing, with the vented member 500 extending from the cover member 600 and into association with the drain chamber 340. Of course, in some instances, the vented member 500 may be an entirely separate component from the cover member 600. In other instances, the vented member 500 may be integrally formed with the sump 14 such that the vented member 500 is an integral portion of the overall sump 14 design in association with the drain chamber 340. In any instance, the vented member 500 forms a portion of the drain chamber 340 and is associated therewith to allow washing fluid to pass therethrough, while substantially retaining comminuted contaminants within the drain chamber 340, as previously described, regardless of the manner in which the vented member 500 is associated with the drain chamber 340.

With further reference to FIG. 4, a circulation pump volute receptacle 110 defined by the sump 14 may only include a semi-circular flange capable of partially surrounding a pump impeller (due to, for example, molding limitations). As such, according to one particular embodiment, the cover member 600 may cooperate with the circulation pump volute receptacle 110 to define the circulation pump housing encompassing the circulation pump impeller. The cover member 600 may be secured, fastened, or otherwise operably engaged with the sump 14/circulation pump volute receptacle 110 in any suitable fluid-tight manner. In this regard, the vented member 500 may also be secured, fastened, or otherwise operably engaged with the sump 14/drain chamber 340 in any suitable manner such that the vented member 500 is in association with the drain chamber 340, regardless of the manner in which the vented member 500 is in association with the drain chamber 340.

In one particular aspect, the cover member 600 may include a drain chamber cover portion 530 extending over the drain chamber receptacle and at least partially forming the vented member 500. The drain chamber cover portion 530 may be configured to interact with the drain chamber receptacle defined by the sump 14 to form the drain chamber 340. Further, the cover member 600 may include a circulation pump washing fluid outlet 570. According to one aspect, the circulation pump washing fluid outlet 570 may be configured to extend through a second filter device receptacle 76 defined by the second filter device 70 to connect to the delivery channel 202 for supplying washing fluid directed through the circulation pump washing fluid outlet 570 to the tub portion 12 of the dishwasher 10 via, for example, the lower spray arm 20A.

According to some embodiments of the present invention, as shown in FIGS. 3-10, the first vent 510 may comprise a plurality of apertures 512 or other filtering structures defined by and extending through the vented member 500 which allow the washing fluid to pass therethrough, and back into the sump 14, while retaining the macerated contaminants within the drain chamber 340. In order to accomplish the desired straining/filtering effect, the vented member 500 may also be configured to implement channel(s), baffle(s), orifice (s), a mesh structure, and/or any other suitable structure(s), in addition to or in the alternative to the illustrated first vent 510. Such a configuration using the straining/filtering effect of the vented member 500 thus provides an additional mechanism (other than gravity) for separating food soils from the washing fluid and preventing such food soils from re-entering the re-circulation flow of the washing fluid, should there be any flow/overflow from the drain chamber 340.

In some instances, the first vent 510 defined by the vented member 500 may be configured to provide some restriction to the flow of washing fluid therethrough. In some instances, the flow restriction may be provided by or intensified by accumulated particles/contaminants strained/filtered from the washing fluid. As such, according to some embodiments, the filtration system 300 may also comprise an optional/supplemental particle collection chamber 360 in fluid communication with the drain chamber 340. That is, the restricted flow of the washing fluid through the vented member 500 may provide an opportunity for lateral flow of the washing fluid, as generally illustrated by arrows A6. The vented member 500 may thus also extend laterally to cover the particle collection chamber 360 also defined by a portion of the sump 14. The portion of the vented member 500 extending over the particle collection chamber 360 may also define a second vent, generally designated 520, comprising a second plurality of apertures 522 or other filtering structures, similar to the first vent 510 of the vented member 500 associated with the drain chamber 340, thereby facilitating flow of washing fluid through the second vent 520 and providing an additional/supplemental filtering mechanism, as generally illustrated by arrow A7. According to one aspect, the apertures 522 of the second vent 520 extending over the particle collection chamber 360 may be of a smaller size than the apertures 512 of the first vent 510 extending over the drain chamber 340 to cause fine or finer particles (i.e., particles of a size that would allow them to pass through the first vent 510) to be retained within the particle collection chamber 360. That is, the second vent 520 provides a filter mechanism capable of retaining particles carried by the dishwashing fluid that would otherwise be capable of passing through the first vent 510. In this manner, finer particles may be filtered from the washing fluid and retained in the particle collection chamber 360.

According to some embodiments, the vented member 500 may also be configured to facilitate the lateral flow of the washing fluid from the drain chamber 340 toward the particle collection chamber 360 through one or more washing fluid channels 540 defined at least partially by the vented member 500. For example, the use of supplemental rib structures 550 defining such washing fluid channels 540 may be implemented. Such rib structures 550 may be, in some instances, configured to prevent larger particles from entering the particle collection chamber 360 such that the larger particles are retained within the drain chamber 340 and prevented from becoming lodged or otherwise retained within the particle collection chamber 360.

In further embodiments, the vented member 500 may be disposed below the normal water/washing fluid level required for operation (i.e., during a washing fluid circulation procedure) of the dishwasher 10, as illustrated in FIG. 10. Accordingly, during a draining process the washing fluid may be at least partially drawn back through the first and second vents 510, 520 (generally illustrated by arrows A8, and wherein arrow A9 illustrates washing fluid flowing from the particle collection chamber 360 into the drain chamber 340) defined by the vented member 500, and toward the drain chamber port 342/drain pump inlet (as generally illustrated by arrow A10) of the drain chamber 340. In this manner, the washing fluid is drawn from the wash fluid circulation system 200 and through the drain chamber 340, via the first vent 510 and/or second vent 520 defined by the vented member 500, to the drain pump fluid outlet 164 (generally illustrated by arrow A11), through actuation of the drain pump 150. In this manner, the vented member 500 may essentially be "backflushed" to remove any accumulated particles/contaminants, as the washing fluid is being drained through the drain chamber 340. Further, the washing fluid drawn back through the first and second vents 510, 520 may also function to "backflush" or otherwise clean the particle collection chamber 360, and/or the drain chamber 340, in addition to the first and second vents 510, 520 (in some instances, without the need for dedicated cleaning jets of high pressure washing fluid to provide the backflushing/cleaning action). Of course, the presence of the particle collection chamber 360 and the second vent 520 is not required for the described backflush operation. That is, in some instances, the filtration system 300 may not include the second vent 520 or the particle collection chamber 360. In such instances, the backflush function may still be accomplished and the washing fluid drawn through the first vent 510 in the same manner as described above to clean the first vent 510 and drain chamber 340.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filtration system for a dishwasher, comprising:

a macerator chamber adapted to house a macerator device, the macerator device and the macerator chamber comprising a macerator system separately operable from a washing fluid circulation system, the macerator chamber being configured to receive washing fluid for the macerator device to comminute contaminants within the washing fluid; and a drain chamber in fluid communication with the macerator chamber and configured to receive the washing fluid and comminuted contaminants therefrom via a fluid port therebetween, the drain chamber further having a vented member associated therewith, the vented member defining at least one first vent providing fluid communication between the drain chamber and the washing fluid circulation system, the vented member being spaced apart from the fluid port, and being configured to strain the comminuted contaminants from the washing fluid so as to retain the comminuted contaminants within the drain chamber while allowing the washing fluid to pass therethrough to the washing fluid circulation system, wherein the vented member further defines at least one second vent laterally displaced from the at least one first vent, the second vent configured to strain finer comminuted contaminants from the washing fluid than the first vent.

2. A filtration system according to claim 1 further comprising a drain pump in communication with the drain chamber, wherein the vented member associated with the drain chamber is disposed below an operational fluid level associated with the washing fluid circulation system such that the washing fluid is drawn from the wash fluid circulation system and through the drain chamber, via the at least one first vent defined by the vented member, by actuation of the drain pump to thereby backflush the vented member as the washing fluid is being drained through the drain chamber.

3. A filtration system according to claim 1 wherein the vented member is further associated with a particle collection chamber in fluid communication with the drain chamber that is configured to retain the finer comminuted contaminants from the washing fluid, such that the at least one second vent provides fluid communication between the particle collection chamber and the washing fluid circulation system.

4. A filtration system according to claim 3 wherein the at least one second vent comprises a plurality of apertures smaller than the at least one first vent.

5. A filtration system according to claim 3 wherein the drain chamber is configured to be in fluid communication with the particle collection chamber via a washing fluid channel at least partially defined by the vented member, the vented member being further configured to cooperate with the drain chamber and the particle collection chamber to facilitate lateral flow of the washing fluid and comminuted contaminants therebetween.

6. A filtration system according to claim 1 further comprising a cover member having the vented member integrally formed as a portion thereof, the cover member being configured to define at least a portion of the washing fluid circulation system.

7. A dishwasher, comprising:

a tub portion adapted to receive dishware therein;

a washing fluid circulation system configured to circulate washing fluid about the dishware within the tub portion;

a maceration system separately operable with respect to the washing fluid circulation system and in fluid communication with the tub portion, the maceration system comprising a macerator device housed by a macerator chamber, the macerator chamber being configured to receive washing fluid from the tub portion for the macerator device to comminute contaminants within the washing fluid; and a drain chamber in fluid communication with the macerator chamber and configured to receive the washing fluid and comminuted contaminants therefrom via a fluid port therebetween, the drain chamber further having a vented member associated therewith, the vented member defining at least one first vent providing fluid communication between the drain chamber and the washing fluid circulation system, the vented member being spaced apart from the fluid port, and being configured to strain the comminuted contaminants from the washing fluid so as to retain the comminuted contaminants within the drain chamber while allowing the washing fluid to pass therethrough to the washing fluid circulation system, wherein the vented member further defines at least one second vent laterally displaced from the at least one first vent, the second vent configured to strain finer comminuted contaminants from the washing fluid than the first vent.

8. A dishwasher according to claim 7 further comprising a drain pump in communication with the drain chamber, wherein the vented member associated with the drain chamber is disposed below an operational fluid level associated with the washing fluid circulation system such that the washing fluid is drawn from the wash fluid circulation system and through the drain chamber, via the at least one first vent defined by the vented member, by actuation of the drain pump to thereby backflush the vented member as the washing fluid is being drained through the drain chamber.

9. A dishwasher according to claim 7 further comprising a straining arrangement disposed between the tub portion and the maceration and washing fluid circulation systems, the straining arrangement comprising a coarse strainer configured to allow washing fluid to pass therethrough to the washing fluid circulation system while retaining contaminants within the tub portion, the coarse strainer being further configured to interact with the washing fluid circulated within the tub portion such that the washing fluid transports the contaminants toward a particle trap configured to collect the washing fluid and contaminants, and to direct the washing fluid and contaminants to the maceration system.

10. A dishwasher according to claim 7 wherein the vented member is further associated with a particle collection chamber in fluid communication with the drain chamber that is configured to retain the finer comminuted contaminants from the washing fluid, such that the at least one second vent provides fluid communication between the particle collection chamber and the washing fluid circulation system.

11. A dishwasher according to claim 8 wherein the at least one second vent comprises a plurality of apertures smaller than the at least one first vent.

12. A dishwasher according to claim 10 wherein the drain chamber is configured to be in fluid communication with the particle collection chamber via a washing fluid channel at least partially defined by the vented member, the vented member being further configured to cooperate with the drain chamber and the particle collection chamber to facilitate lateral flow of the washing fluid and comminuted contaminants therebetween.

13. A dishwasher according to claim 7 wherein the washing fluid circulation system further comprises a circulation pump assembly driven by a circulation pump motor, the circulation pump motor being further configured to drive the macerator device.

14. A dishwasher according to claim 7 further comprising a cover member having the vented member integrally formed as a portion thereof, the cover member being configured to define at least a portion of the washing fluid circulation system.

15. A method of filtering contaminants in a dishwasher, comprising:

circulating washing fluid about dishware within a tub portion with a washing fluid circulation system in fluid communication therewith;

directing the washing fluid from the tub portion to a maceration system separately operable with respect to the washing fluid circulation system, the maceration system comprising a macerator device housed by a macerator chamber, the macerator chamber being configured to receive the washing fluid for the macerator device to comminute contaminants therein;

directing the washing fluid and comminuted contaminants from the macerator chamber to a drain chamber via a fluid port therebetween, the drain chamber further having a vented member associated therewith, the vented member being spaced apart from the fluid port and defining at least one first vent providing fluid communication between the drain chamber and the washing fluid circulation system, wherein the vented member further defines at least one second vent laterally displaced from the at least one first vent, the second vent configured to strain finer comminuted contaminants from the washing fluid than the first vent; and straining the comminuted contaminants from the washing fluid with the vented member so as to retain the comminuted contaminants within the drain chamber while allowing the washing fluid to pass through the at least one first vent to the washing fluid circulation system.

16. A method according to claim 15 wherein the dishwasher further comprises a drain pump in communication with the drain chamber, and the vented member associated with the drain chamber is disposed below an operational fluid level associated with the washing fluid circulation system, and wherein the method further comprises drawing the washing fluid from the wash fluid circulation system and through the drain chamber, via the at least one first vent defined by the vented member, by actuating the drain pump to thereby backflush the vented member as the washing fluid is being drained through the drain chamber.

17. A method according to claim 15 wherein the dishwasher further comprises a straining arrangement disposed between the tub portion and the maceration and washing fluid circulation systems, the straining arrangement comprising a coarse strainer configured allow washing fluid to pass therethrough to the washing fluid circulation system while retaining contaminants within the tub portion, and a particle trap configured to collect the washing fluid and contaminants, and to direct the washing fluid and contaminants to the maceration system, and wherein the method further comprises directing the washing fluid circulated within the tub portion toward the coarse strainer such that the washing fluid transports the contaminants toward the particle trap.

18. A method according to claim 15 wherein the vented member is further associated with a particle collection chamber in fluid communication with the drain chamber that is configured to retain the finer comminuted contaminants from the washing fluid, such that the at least one second vent provides fluid communication between the particle collection chamber and the washing fluid circulation system, and wherein the method further comprises directing the washing fluid and comminuted contaminants to flow laterally between the drain chamber and the particle collection chamber via a washing fluid channel at least partially defined by the vented member.

19. A filtration system according to claim 1, wherein the vented member comprises one or more washing fluid channels defined between the first vent and the second vent for facilitating lateral flow therebetween.

20. A filtration system for a dishwasher, comprising:

a macerator chamber adapted to house a macerator device, the macerator device and the macerator chamber comprising a macerator system separately operable from a washing fluid circulation system, the macerator chamber being configured to receive washing fluid for the macerator device to comminute contaminants within the washing fluid; and a drain chamber in fluid communication with the macerator chamber and configured to receive the washing fluid and comminuted contaminants therefrom via a fluid port therebetween, the drain chamber further having a vented member associated therewith, the vented member defining at least one first vent providing fluid communication between the drain chamber and the washing fluid circulation system, the vented member being spaced apart from the fluid port, and being configured to strain the comminuted contaminants from the washing fluid so as to retain the comminuted contaminants within the drain chamber while allowing the washing fluid to pass therethrough to the washing fluid circulation system, wherein the vented member further defines at least one second vent laterally displaced from the at least one first vent, and the vented member is further associated with a particle collection chamber in fluid communication with the drain chamber, such that the at least one second vent provides fluid communication between the particle collection chamber and the washing fluid circulation system, and wherein the drain chamber is configured to be in fluid communication with the particle collection chamber via a washing fluid channel at least partially defined by the vented member, the vented member being further configured to cooperate with the drain chamber and the particle collection chamber to facilitate lateral flow of the washing fluid and comminuted contaminants therebetween.

* * * * *